US005184791A

United States Patent [19]

Kais et al.

[11] Patent Number: 5,184,791

[45] Date of Patent: Feb. 9, 1993

[54] FROG TIP THAT CAN BE SHIFTED RELATIVE TO THE WING RAILS

[75] Inventors: Alfred Kais, Lich-Eberstadt; Erich Nuding, Aalen; Sebastian Benenowski, Butzbach, all of Fed. Rep. of Germany

[73] Assignee: BWG Butzbacher Weichenbau GMBA, Butzbach, Fed. Rep. of Germany

[21] Appl. No.: 694,543

[22] Filed: May 2, 1991

[30] Foreign Application Priority Data

May 4, 1990 [DE] Fed. Rep. of Germany ..... 4014346

[51] Int. Cl.[5] ..... E01B 7/14

[52] U.S. Cl. ..... 246/468; 246/385

[58] Field of Search ..... 246/382, 385, 454, 455, 246/456, 458, 460, 461, 468, 469, 470, 471, 472

[56] References Cited

U.S. PATENT DOCUMENTS

| | | | |
|---|---|---|---|
| 569,653 | 10/1896 | McCann | 246/385 |
| 859,101 | 7/1907 | Odenkirk et al. | 246/385 |
| 1,025,369 | 5/1912 | Chamness | 246/385 |
| 1,313,780 | 8/1919 | Betts . | |
| 2,377,273 | 5/1945 | Siebert | 246/385 X |
| 3,784,134 | 1/1974 | Claus et al. | 246/446 |
| 3,787,680 | 1/1974 | Perrot | 246/468 X |
| 4,953,814 | 9/1990 | Oswald et al. | 246/385 X |

FOREIGN PATENT DOCUMENTS

| | | | |
|---|---|---|---|
| 2061264 | 6/1972 | Fed. Rep. of Germany | 246/468 |
| 2114926 | 7/1972 | Fed. Rep. of Germany . | |
| 141537 | 5/1980 | Fed. Rep. of Germany | 246/472 |

*Primary Examiner*—Michael S. Huppert
*Assistant Examiner*—Scott L. Lowe
*Attorney, Agent, or Firm*—Beveridge, DeGrandi, Weilacher & Young

[57] ABSTRACT

A frog tip that can be moved relative to the wing rail is proposed, in which the contact surfaces each curve away from the frog tip and the wing rails in a lengthwise direction.

13 Claims, 1 Drawing Sheet

FROG TIP THAT CAN BE SHIFTED RELATIVE TO THE WING RAILS

Figure 1:
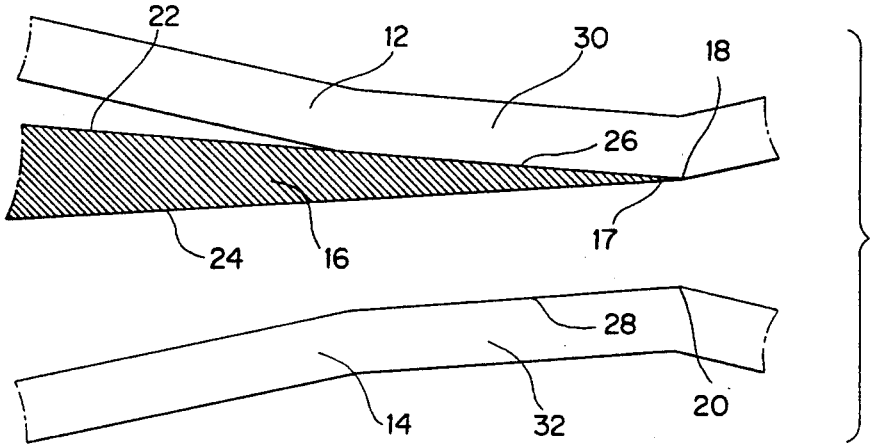
FIG. 1 PRIOR ART

The present invention relates to a frog tip that can be shifted relative to the wing rails, each wing rail being bent in the area of the tip towards the frog tip, it being possible to move sections of the wing rail towards the tip of the frog and vice versa.

Articulated frog tips or frog tips that are moved by springs are familiar from known switch and cross-over designs, which permit the frog tips to be moved against the track that continues from the blades, and which are referred to as wing rails. Within the area of the tip of the frog tip, the running edges of the sections of track that cross over are interrupted. In known designs, the bend points of the wing rails and the frog tip are so oriented relative to each other that their tips basically lie at the bend point or essentially in the bend point.

Both the wing rails and the frog tip follow a straight line from the tip or to the bend point, respectively, within the area where they join. The frog tip can be really narrow, depending on the angle subtended by the sections of rail before and after the bend point. This results in increased wear.

Frequently, the frog tip does not lie against the wing rails to the required extent, so that a gap is formed by which, on the one hand, the quality of the ride is impaired when the points or crossings are passed over and which, on the other hand, involves the danger that the frog tip may be destroyed.

It is the task of the present invention to develop a frog tip of the type described in the introduction hereto which can be moved relative to the wing rails and which improves the comfort of the ride experienced when the train moves over the frog. In addition, the existence of a gap between the wing rails and the frog tip should not result in any impairment, and in particular should not lead in an increased load being placed on the frog tip.

Essentially, and according to the present invention, this task has been solved in that the frog tip and the wing rails are curved, at least in some areas, within the area in which they lie against each other. In this regard, it is preferred that the radius of curvature of the wing rails and of the frog tip within this area, which is to say relative to the surfaces that are against each other and which in the frog tip is also a running edge, depending on whether it is crossed, are of equal size. In which connection, if necessary, the radii of curvature of each wing rail, and thus of the section of the frog tip that can be moved to lie against a wing rail, can differ from each other.

In a preferred embodiment of the invention, it is foreseen that the tip of the frog tip is set back relative to the bend point of the wing rails. This protects the frog tip without affecting the rolling characteristics of the wheel passing over the frog.

Because of the curved shape of the frog tip and because of the fact that the running edge is curved out in a corresponding manner because of this, the point of contact of the wheel passing across the frog is affected such that the shock-like transition that frequently occurs is reduced. In addition, the area of the frog tip can be made thicker because, according to the present invention, within this area it is possible to achieve a greater distance between the running edges because of the path of the running edges which is convex and curved on both sides.

A particularly advantageous development of the concept of the present invention results if the curved path of the frog tip extends beyond the area in which the frog lies against the wing rails. It is advantageous that, outside the area in which the frog tip lies against the wing rails or vice versa, the wing rail in its turn follows a tangent that is generated by the point of contact with the wing rail that is furthest from the tip of the frog.

Additional details, advantages, and features of the present invention are set out not only in the claims but also in a description of a preferred embodiment of the present invention shown in the drawings appended hereto. These drawings show the following.

Figure 2:
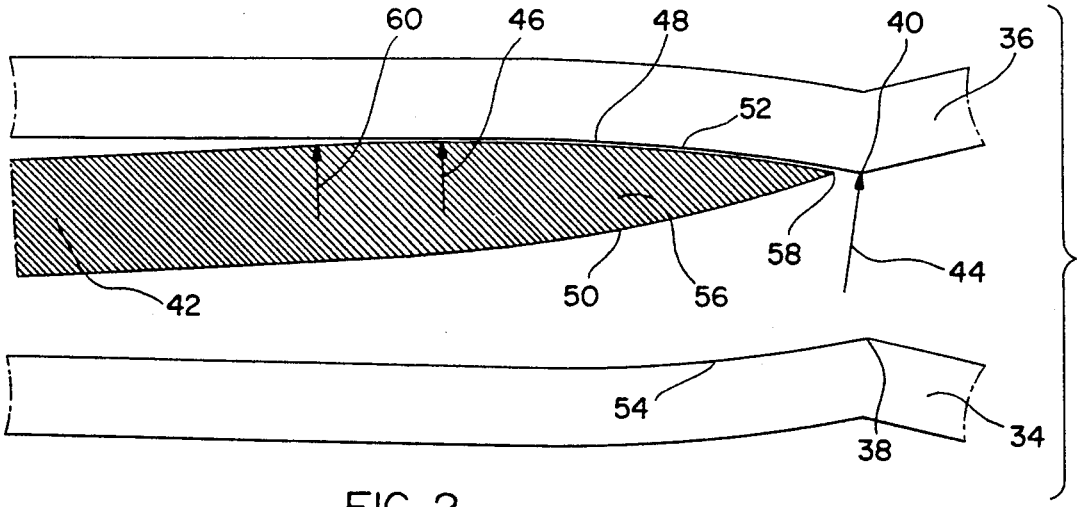

FIG. 1: the frog area of a switch or crossing according to the prior art;

FIG. 2: the frog area configured according to the present invention.

Frogs are formed in switches or crossings by the intersection of sections of rail. Within the area of the frog, the running edges of the sections of rail that cross each other are interrupted. The sections of rail that continue from the blades are bent in the area of the frog.

As is shown in FIG. 1, which illustrates the prior art, the wing rails (12) and (14), between which the frog (16) is arranged directly in the front end of the frog tip (16), which is to say in the area of the tip (17) of the frog tip (16) there is a bend point (18) or (20), respectively, away from which the wing rails (12) and (14) are bent outwards and then continue in a straight line.

The sides (22) and (24) of the frog tip (16) can be laid against the wing rails (12), (14) in an area (26) or (28), respectively, which is to say in the bend area (30) or (32), respectively. To this end, the frog tip (16) can be articulated or can be moved by a spring. A corresponding design is seen in moveable wing rails which can be shifted towards the frog tip.

As is shown in FIG. 1, at its front area, which is to say in the area of the tip (17) of the frog (16), the frog (16) is very narrow. Because of this, the frog tip (16) is subjected to an increased amount of wear. Very frequently, it is often the case that a gap is formed between the wing rail (12) or (14) and the frog tip (16) that normally lies against it, which is to say in the area (26) or (28), respectively. This has an adverse effect on ride comfort when the frog (16) is crossed.

In order to avoid the disadvantages discussed above, according to the present invention (FIG. 2), the area of the frog is so configured that its wing rail (34) and (36) does no continue in a straight line beyond the bend point (38) or (40), respectively, but is curved. This curved path is predominant, at least in the areas in which the frog tip (42) and the wing rail (36) or (34), respectively, can lie against each other, which is to say, relative to the wing rail (36), between the arrows (44) and (46). This area is numbered (52). Consequently, the contact surface (48) of the frog (42) is curved accordingly. Within this area, the contact surfaces (52) and (48) of the wing rail (36) and the frog (42) are of the same radius of curvature when the surfaces lie against each other.

The surface (50) that is opposite the contact surface (48), which can be moved into contact with a similarly curved area (54) or contact surface is of a similarly curved or arced shape.

The radius of curvature in the area (54) of the wing rail (34) and that of the proximate side or surface (50) of the frog (42) can correspond to that of the area (52). However, this is not absolutely essential. On the contrary, the radii of curvature can differ from each other.

Because of the fact that the frog (42) in the areas (52) and (54), which is to say the contact surfaces (48) and (50) and thereby the rolling edges, are curved outwards, there is provided the advantage that the distance between the rolling edges in the areas (52) and (54) are larger. Consequently, the tip area (56) of the frog (42) can be made thicker, which provides for greater stability and results in less wear.

In addition, FIG. 2 shows that the tip (58) of the frog tip (42) is actually set back, which is to say is moved back, relative to the switch blade. The frog tip (42) is additionally protected by this. In this case, the distance in switches of smaller curvature is smaller than in those of greater curvature. The distance between the tip (58) and the bend point (38) or (40), respectively, can, for example, be from 80 to 100 mm.

The curved shape of the frog tip (42) is seen not only in those areas (48) and (50) that lie against the wing rails (34) and (36), but extends beyond this area as far as the arrow (60) in FIG. 2. After this, it follows the normal path which is governed by the geometry of the switches. In contrast to this, the wing rails (34) and (36) are to be curved only in the area of their contact surfaces, which is to say in the areas (52) and (54). At the end of the area (52) or (54), respectively, which is to say beginning from the arrow (46) the wing rails (34) or (36), respectively, are tangential, which is to say they follow the tangent generated at the end contact point (arrow 46).

We claim:

1. A frog assembly, comprising:

a frog tip having a first running edge and a second running edge each extending lengthwise along said frog tip;

a first wing rail having a bent section in an area adjacent said frog tip;

a second wing rail having a bent section in an area adjacent said frog tip, said frog tip being positioned between said first and second wing rails such that a lengthwise section of said first running edge is adjacent a lengthwise section of said first wing rail and is adapted for contact therewith upon relative movement therebetween and such that a lengthwise section of said second running edge is adjacent a lengthwise section of said second wing rail and is adapted for contact therewith upon relative movement therebetween, at least a portion of the lengthwise section of said first running edge having a curvature which curves lengthwise and at least a portion of said lengthwise section of said first wing rail having a curvature which curves lengthwise and which corresponds with the curvature of the curved portion of said first running edge such that, upon contact, a nesting arrangement is provided between the curved portion of said first wing rail and the curved portion of said first running edge, and at least a portion of the lengthwise section of said second running edge having a curvature which curves lengthwise and at least a portion of said lengthwise section of said second wing rail having a curvature which curves lengthwise and which corresponds with the curvature of the curved portion of said second running edge such that, upon contact, a nesting arrangement is provided between the curved portion of said second wing rail and the curved portion of said second running edge.

2. A frog assembly as recited in claim 1 wherein the curved portion of said first running edge and the curved portion of the first wing rail have the same radius of curvature.

3. A frog assembly as recited in claim 2 wherein the curved portion of said second running edge and the curved portion of said second wing rail have the same radius of curvature.

4. A frog assembly s recited in claim 1 wherein the curved portion of the first running edge and the curved portion of the first wing rail have the same radius of curvature, the curved portion of said second running edge and the curved portion of said second wing rail have the same radius of curvature, and the curved portion of said first running edge has the same radius of curvature as the curved portion of said second running edge.

5. A frog assembly as recited in claim 1 wherein the curved portion of said first running edge curves outward in convex fashion with respect to a center portion of said frog tip and the curved portion of said first wing rail curves inwardly in concave fashion with respect to a center portion of said first wing rail and wherein the curved portion of said second running edge curves outward in convex fashion with respect to the center portion of said frog tip and the curved portion of said second wing rail curves inwardly in concave fashion with respect to a center portion of said second wing rail.

6. A frog assembly as recited in claim 1 wherein said frog tip has a forward end which is positionable at a point on each of said wing rails which lies between the bent section of said wing rails and the curved section of said wing rails.

7. A frog assembly as recited in claim 6 wherein, when said frog tip is in contact with one of said wing rails it is positioned rearward from the respective bent section a distance from 80 to 100 mm.

8. A frog assembly as recited in claim 1 wherein the curved portion of said first running edge is longer than the curved portion of said first wing rail which contacts said first running edge when said first running edge and said first wing rail are in contact.

9. A frog assembly as recited in claim 1 wherein said first wing rail includes a straight section extending off of the curved portion of said first wing rail and away from the bent portion of said first wing rail, and said straight section extending tangentially off of a contact point formed between the curved portion of said first wing rail and the curved portion of said first running edge, when in contact, which is farthest from the bent section of said first wing rail and wherein said second wing rail includes a straight section extending off of the curved portion of said second wing rail and away from the bent portion of said second wing rail, and said straight section extending tangentially off of a contact point formed between the curved portion of said second running edge and the curved portion of said second wing rail, when in contact, which is farthest from the bent section of said second wing rail.

10. A frog assembly, comprising:

a first wing rail having an interior edge which includes a straight section, a bent section and a curved portion between said straight and bent sections, and said curved portion being curved lengthwise along said first wing rail;

a frog tip having a first running edge which includes a front end, a curved portion extending from said front end and a straight section extending from the curved portion of said frog tip, the curved portion of said first running edge being curved in a lengthwise direction and positioned adjacent the curved portion of the interior edge of said first wing rail and adapted for contact therewith such that, upon contact, the curved portion of said first running edge and the curved portion of said first wing rail are placed in a nested arrangement;

a second wing rail having an interior edge which includes a straight section, a bent section and a curved portion between said straight and bent section, and said curved portion of said second wing rail being curved in a lengthwise direction, said frog tip including a second running edge which includes a curved portion extending from the front end of said frog tip and a straight section extending rearwardly off of the curved portion of said second running edge, the curved portion of the second running edge being positioned adjacent the curved portion of the interior edge of said second wing rail and adapted for contact therewith, the curved portion of the second running edge being curved in a lengthwise direction such that upon contact between said second running edge and said second wing rail the curved portion of said second running edge and said second wing rail are placed in a nested relationship.

11. A frog assembly as recited in claim 10 wherein the front end of said frog tip is positionable rearwardly with respect to the bent sections of said wing rails.

12. A frog assembly as recited in claim 10 wherein said first and second running edges curve outward in convex fashion from a central area of said frog tip.

13. A frog tip assembly as recited in claim 10 wherein the curved portion of said first wing rail and the curved portion of said first running edge have an equal radius of curvature.

* * * * *